United States Patent [19]

Miura

[11] 4,147,179

[45] Apr. 3, 1979

[54] PRESSURE GOVERNOR VALVE EQUIPPED WITH FLOW CONTROL VALVE

[75] Inventor: Tomohiro Miura, Soka, Japan

[73] Assignee: Shoketsu Kinzoku Kogyo Co., Ltd., Tokyo, Japan

[21] Appl. No.: 771,116

[22] Filed: Feb. 23, 1977

[30] Foreign Application Priority Data

Feb. 24, 1976 [JP] Japan ..... 51-20076[U]

[51] Int. Cl.[2] ..... F15B 13/04

[52] U.S. Cl. ..... 137/599; 91/443; 91/447; 137/613

[58] Field of Search ..... 91/443, 447, 448; 137/505.26, 596, 599, 613

[56] References Cited

U.S. PATENT DOCUMENTS

| | | | |
|---|---|---|---|
| Re. 29,292 | 7/1977 | Tennis | 91/447 X |
| 598,579 | 2/1898 | Shields et al. | 137/613 |
| 941,153 | 11/1909 | Krichbaum | 137/505.26 X |
| 1,210,891 | 1/1917 | Blanchard et al. | 137/613 X |
| 2,141,715 | 12/1938 | Hilger | 137/613 X |
| 2,272,684 | 2/1942 | Vickers | 91/447 X |
| 2,285,049 | 6/1942 | Parks | 137/505.26 X |
| 2,495,785 | 1/1950 | Stephens | 91/447 X |
| 2,501,483 | 3/1950 | Taylor | 91/443 X |
| 3,951,162 | 4/1970 | Wilke | 91/447 X |

FOREIGN PATENT DOCUMENTS

| | | | |
|---|---|---|---|
| 5704 | 11/1901 | Austria | 137/613 |
| 1922073 | 11/1970 | Fed. Rep. of Germany | 91/447 |
| 1431562 | 4/1976 | United Kingdom | 137/505.26 |

*Primary Examiner*—Gerald A. Michalsky
*Attorney, Agent, or Firm*—Robert G. Mentag

[57] ABSTRACT

A pressure governor valve having a casing with an inlet on the primary side and an outlet on the secondary side thereof. A passage is formed in the casing and communicates the inlet with the outlet. A pressure governor valve is mounted in the casing for closing said passage on the inlet side thereof, and a flow control valve is interposed at an intermediate portion of the passage between the outlet and the pressure governor valve.

1 Claim, 2 Drawing Figures

PRESSURE GOVERNOR VALVE EQUIPPED WITH FLOW CONTROL VALVE

SUMMARY OF THE INVENTION

It has been practiced widely to apply a fluid pressure to a piston fitted slidably into a cylinder and to transmit movement of the piston moved by the pressure as work through a rod attached to the piston. In this instance, the necessary output of the cylinder is determined by the pressure which moves the piston through a stroke required to accomplish work (generally a pressure on the side of the piston head). Theoretically, therefore, a pressure for the return stroke of the piston (a pressure on the rod side) must be a minimum pressure that is sufficient to cause the return stroke of the piston. In ordinary pistons currently in use, however, the same pressure is practically applied to both head side and rod side of a cylinder by a direction switch valve after a pressure adjustment is made. So far as the return pressure on the rod side is concerned, the energy is consequently consumed in vain.

The primary object of the present invention is to provide a pressure governor valve equipped with a flow control valve which, when adapted to the above-described applications, prevents the energy loss to the maximum possible extent.

| | |
|---|---|
| 1 casing | 2 inlet |
| 3 outlet | 4 passage |
| 5 valve body | 6 pressure governor valve |
| 7 rod | 8 valve seat |
| 9 piston | 10 inner wall |
| 11 chamber | 12 pressure governing spring |
| 13 pressure governing spring guide | 14 pressure governing screw |

Figure 1:
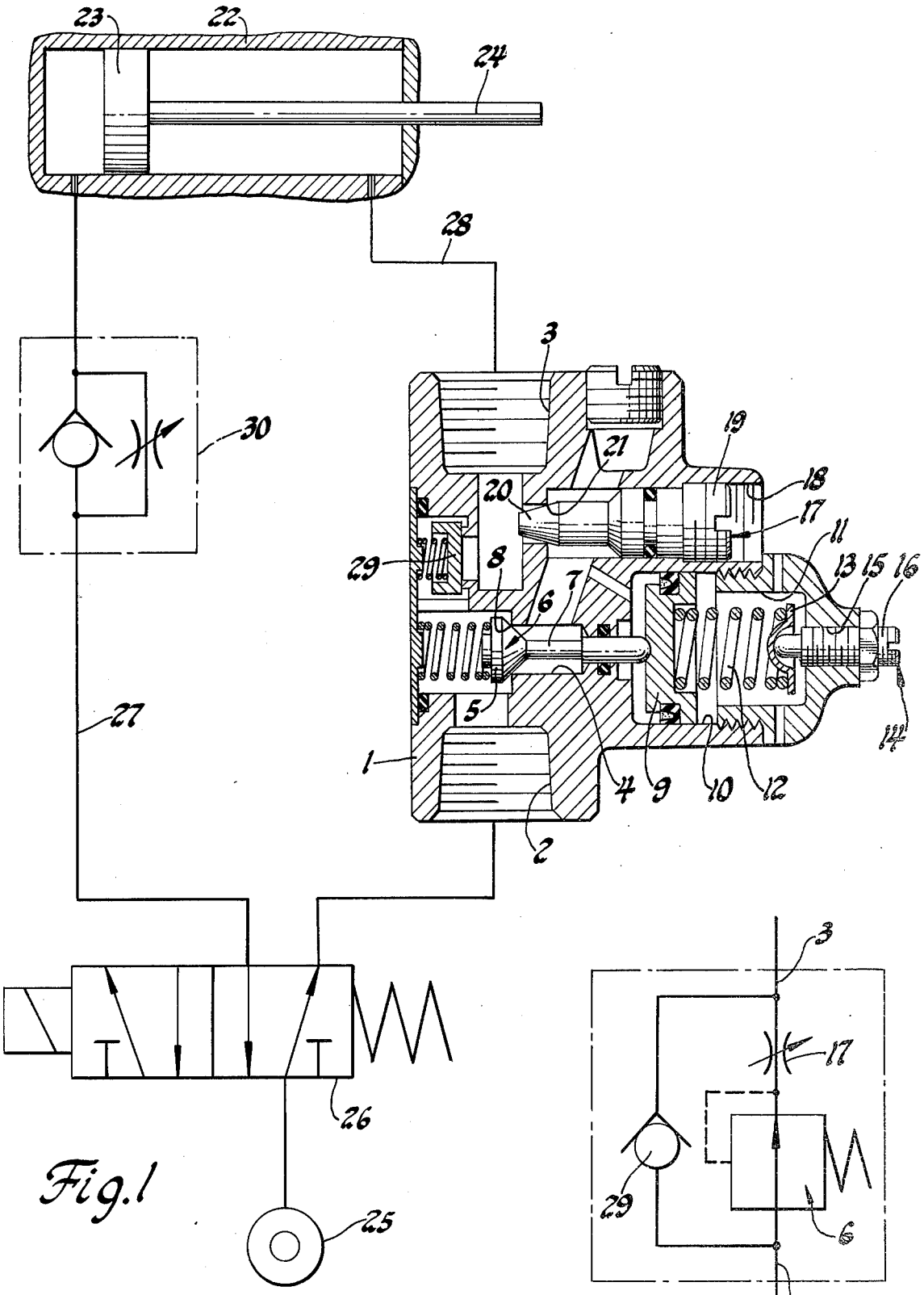
FIG. 1 is a diagram illustrating a typical example of a mode of usage of the valve of the present invention wherein the reference numerals designate the following members, respectively.
Figure 2:
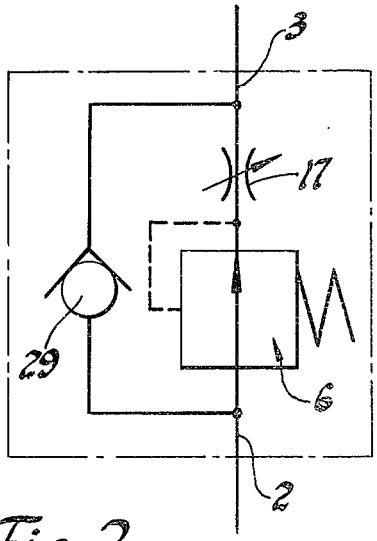

FIG. 2 is a schematic diagram of the valve shown in FIG. 1.

DESCRIPTION OF THE PREFERRED EMBODIMENT

Referring now to FIG. 1, the reference numeral 1 designates the casing of the valve which has an inlet 2 and an outlet 3. Inside the casing 1 is formed a passage 4 which communicates the inlet 2 and the outlet 3. A pressure governor valve 6 has a valve body 5 which opens and closes said passage 4 on the side of the inlet 2 and is fitted to a valve seat 8 disposed on the passage 4. A rod 7 is attached to the pressure governor valve 6.

The above-mentioned rod 7 is extended to pass through the passage 4 and one end thereof abuts a piston 9 which is disposed to slide in an air- and water-tight manner along the inner wall 10 of a chamber 11. One end of a pressure governing spring 12 is engaged with the piston 9 while the other end of the same is engaged with a pressure governing screw 14 via a pressure governing spring guide 13. The screw has a thread 16 which is screwed into a tapped hole 15 defined on the aforementioned casing 1. Hence, the resiliency of the pressure governing spring 12 acting on the valve body 5 through the piston 9 and the rod 7 can be varied by rotating the pressure governing screw 14.

A flow control valve 17 is disposed in the passage 4 at the intermediate position between the outlet 3 and the pressure governor valve 6 and enables the opening of the passage 4 to be controlled. This valve 17 has a screw thread 19 which is screwed into a tapped hole 18 formed in the casing 1 so that the screwing operation of the screw thread allows a valve body 20 formed in the valve 17 to retract relative to its valve seat 21, thereby controlling the flow rate.

In the pressure governor valve equipped with the flow control valve having the above-described construction, the movement of a piston 23 sliding in an air-tight and water-tight manner inside a cylinder 22 is transmitted through a rod 24 and converted into work. The mode of usage of the valve of this invention is as follows. Among two conduits, i.e., a conduit 27 connected to the head side of the abovementioned cylinder 22 via a direction switch valve 26 from a pressure source 25 and a conduit 28 connected to the rod side, the pressure governor valve equipped with the flow control valve of the present invention is disposed in the latter conduit 28.

In this instance, a pressure applied to the rod side of the cylinder 22 from the pressure source 25 through the direction switch valve 26 is reduced to a minimum necessary extent by the action of the aforementioned pressure governing spring 12. When the direction switch valve 26 is changed over and a predetermined pressure is applied to the head side through the conduit 27, the fluid on the rod side is discharged directly to the inlet side 2 through a check valve 29 disposed at the outlet side 3 of the casing 1. The reference numeral 30 designates a throttle valve equipped with a check valve (with a pressure compensator) that is disposed in the conduit 27.

What is claimed is:

1. A pressure governor valve equipped with a flow control valve which comprises:

a casing having a primary side provided with an inlet and a secondary side provided with an outlet;

a first passage disposed inside said casing and communicating said inlet with said outlet, and having an intermediate portion;

a pressure governor valve, including a valve body, closing said first passage on the side of said inlet;

a rod attached to the valve body of said pressure governor valve and brought into contact with a piston imparted with a load by a pressure governing spring;

said pressure governing spring acting on the valve body of said pressure governor valve and opening said valve with an adjustable pressure to reduce the pressure in said first passage to a predetermined pressure between the pressure governor valve and said outlet during both dynamic flow and static operative conditions;

a flow control valve interposed at the intermediate portion of said passage between said outlet and said pressure governor valve;

a second passage disposed inside said casing in parallel with said first passage and communicating said inlet with said outlet; and, a check valve means mounted in said second passage to block flow from said inlet to said outlet, forcing all fluid flow from said inlet to said outlet through said first passage and allowing return free flow from said outlet to said inlet when inlet pressure is exhausted.

* * * * *